US006468581B1

(12) United States Patent
Pezzulo et al.

(10) Patent No.: US 6,468,581 B1
(45) Date of Patent: Oct. 22, 2002

(54) METHOD FOR MANUFACTURING A METALLIZED LUMINESCENT SCREEN

(75) Inventors: Antimo Pezzulo, Anagni; Alfredo Palumbo, Colleferro; Silvano Dilorio, Pizzone, all of (IT)

(73) Assignee: Thomson Licensing S.A., Boulogne Cedex (FR)

( * ) Notice: Subject to any disclaimer, the term of this patent is extended or adjusted under 35 U.S.C. 154(b) by 0 days.

(21) Appl. No.: 09/577,440

(22) Filed: May 24, 2000

(30) Foreign Application Priority Data

May 25, 1999 (IT) ..... MI99A1155

(51) Int. Cl.[7] ..... B05D 3/02; B05D 5/12
(52) U.S. Cl. ..... 427/64; 427/68; 427/226
(58) Field of Search ..... 427/64, 66, 68, 427/226

(56) References Cited

U.S. PATENT DOCUMENTS

| | | | | | |
|---|---|---|---|---|---|
| 3,574,663 | A | * | 4/1971 | Schniepp | 427/68 |
| 3,582,390 | A | * | 6/1971 | Saulnier | 427/69 |
| 3,821,009 | A | | 6/1974 | Lerner et al. | 117/33.5 |
| 3,981,729 | A | * | 9/1976 | Saulnier | 430/28 |
| 4,022,929 | A | | 5/1977 | Nill et al. | 427/69 |
| 4,590,092 | A | | 5/1986 | Giancaterini et al. | 427/68 |
| 4,990,366 | A | * | 2/1991 | Pezzulo et al. | 427/68 |
| 5,178,906 | A | | 1/1993 | Patel et al. | 427/64 |
| 5,556,664 | A | | 9/1996 | Sasa | 427/64 |

* cited by examiner

*Primary Examiner*—Shrive P. Beck
*Assistant Examiner*—Michael Cleveland
(74) *Attorney, Agent, or Firm*—Joseph S. Tripoli; Carlos M. Herrera; Richard LaPeruta, Jr.

(57) ABSTRACT

A method for manufacturing a metallized luminescent screen, for a cathode-ray tube, includes the steps of:

depositing at least one phosphor layer on an inner surface of a faceplate of a panel to form said luminescent screen, depositing on said layer a sub-layer consisting of a lacquer, drying said sub-layer to form a film, coating at least partially the internal surface of the faceplate panel with an aqueous solution of a copolymer of acrylic/styrene, drying the copolymer coating, depositing a metallic layer onto said copolymer coating, removing the organic materials contained in the luminescent screen, the film and the copolymer coating, by baking the tube panel.

8 Claims, 2 Drawing Sheets

METHOD FOR MANUFACTURING A METALLIZED LUMINESCENT SCREEN

METHOD FOR MANUFACTURING A METALLIZED LUMINESCENT SCREEN

The invention relates to a method for manufacturing a metallized screen on a panel for a cathode ray tube (CRT) and, more particularly, to a method for obtaining a coating of aluminum without metallic surface defect over the internal panel surface, for example, on the phosphor area, blend radius and sidewall.

BACKGROUND OF THE INVENTION

The primary purpose of a metallic layer is to impart to the back surface of a phosphor screen the property of specular reflection, in order to direct all of the light generated in the screen toward the panel glass faceplate, thereby maximizing tube brightness. To achieve this feature, the metallic layer must also be free of defect as blisters, cracks or holes. As is well known in the art, the reflectance of a metallic layer is largely achieved by first depositing one or more organic layers with film-forming features (lacquer) on the inner panel surface, then depositing the metallic layer, and finally removing the organic layers by volatilization during the bake out of the tube. The gas coming from the decomposition of organic material escapes through the metallic layer and may produce blisters, which reduces the metallic layer reflectivity. Flaking of the metallic layer also may occur after the baking step, particularly on the panel sidewall, generating undesirable conductive particles within the tube. Several prior metallizing methods have been disclosed to prevent blistering in the metallic layer deposited on the light-emitting surface.

U.S. Pat. No. 3,821,009, issued to Lerner et al. on Jun. 28, 1974, describes a method of aluminizing a cathode ray tube screen. In this method, a solution of ammonium oxalate, ammonium benzoate, ammonium acetate, ammonium nitrate or citric acid is applied on the organic base substrate. This coating is dried and the solute crystallizes, forming needles that pierce the aluminum layer, thereby allowing the gas to escape. The crystalline solute vaporizes during the tube bake-out process. A drawback of this method is that it is not fully satisfactory because a noticeable number of tubes still show blister on the aluminum layer.

U.S. Pat. No. 4,022,929, issued to Nill et al. on May 10, 1977, describes a method of aluminizing the inside of the panel of a television picture tube. In this method, a coat of lacquer must be roughened, at least at the sidewall of the panel. This roughening can be accomplished by spraying a solution of boric acid or ammonium carbonate onto the lacquer coat, or by roughening the lateral walls of the panel by sand blasting before the lacquer coat is deposited. A drawback of the first method is that, in case of long delay between the anti-blister spray and the metallizing step, a blister occurs, probably because of the moisture content which greatly reduces the anti-blister spray efficiency. An additional drawback of the first method is that, if any of boric acid is over-sprayed onto the phosphor screen, the boron in the boric acid reduces the efficiency of the Zn/Ag blue phosphor, resulting in a dark or yellow appearance of the affected phosphor. A drawback of the second method is, of course, the extra cost for the sand blasting panel treatment.

U.S. Pat. No. 4, 590,092, issued to Giancaterini et al. on May 20,1986, describes an aluminization process of the internal face of the screen of a color television picture tube.

In this process, a layer of ammonium tetra-borate, preferably hydrated, forming micro-crystals, is sprayed on the organic layer, and pierces the aluminum layer, thereby helping the discharge of gas during bake-out of the organic. A drawback of this method is the presence on the phosphor layer of a boric anhydride $B_2O_3$ residue, after baking, that worsens tube light output.

U.S. Pat. No. 5,178,906, issued to Patel et al. on Jan. 12, 1993, describes a method of manufacturing a phosphor screen for a CRT using an adhesion-promoting, blister-preventing formulation. In this method, a formulation of colloidal silica, potassium silicate or sodium silicate is applied on the organic layer, to form a rough surface which provides minute holes in the metallic coating to prevent aluminum blistering during bake-out, and also to increase the adherence of the metallic layer to the underlying surface. A drawback of this method is the presence, after bake-out, of silica or salts on the phosphor surface that reduce tube light output.

U.S. Pat. No. 5,556,664, issued to Sasa et al. on Sep. 17, 1996, describes a method of forming a phosphor screen, in which an intermediate film solution of oxalic acid, ammonium oxalate or boric acid is applied on the phosphor layer before the lacquer layer step. The solution is evaporated and the solute crystallizes, forming an uneven layer that reduces the aluminum layer thickness, allowing gas to escape during organic bake-out. A drawback of this method is the environmental risk because of the low limit of oxalic acid concentration allowed in ambient air in a working room.

Each of the aforementioned processes has one or more drawbacks, including safety and environmental risks, reduced tube brightness due to chemical residuals, and poor quality of the aluminum surface. The present invention is directed to a manufacturing process utilizing a water-based formulation of styrene-acrylic copolymer, which improves the surface quality of the metallic coating, is safe for the environment and which prevents blistering and flaking of the metallic layer in the inner portion of the panel.

SUMMARY OF THE INVENTION

At least one phosphor layer is deposited on an inner surface of a panel to form the luminescent screen. The panel containing the screen is then preheated to a temperature in excess of a minimum film forming temperature, and a formulation of at least one acrylic film forming resin is deposited onto the screen and dried to form the film. Next, a styrene-acrylic copolymer formulation is spayed onto the acrylic film, followed by a metallic coating deposition. The panel bearing the metallized screen is then heated during a baking cycle at a predetermined rate of temperature increase, which includes a temperature range within which the film and the copolymer are volatilized.

DESCRIPTION OF THE DRAWINGS

A fuller understanding of the invention will be obtained by referring to the description and claims, taken in conjunction with the accompanying drawings and photographs in which:

DETAILED DESCRIPTION OF THE PREFERRED EMBODIMENTS

Figure 1:
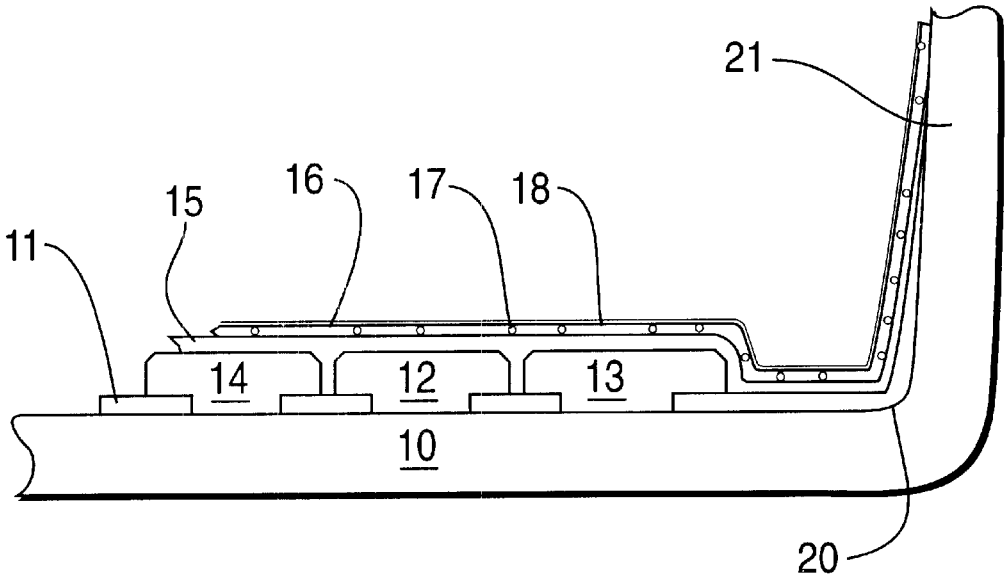
FIG. 1 is a cross-sectional view schematically showing the corner of a panel obtained after the phosphor deposition process, the filming process, the copolymer coating and after a metal, preferably aluminum, vapor deposition process according to the embodiment of the present invention.
Figure 2:
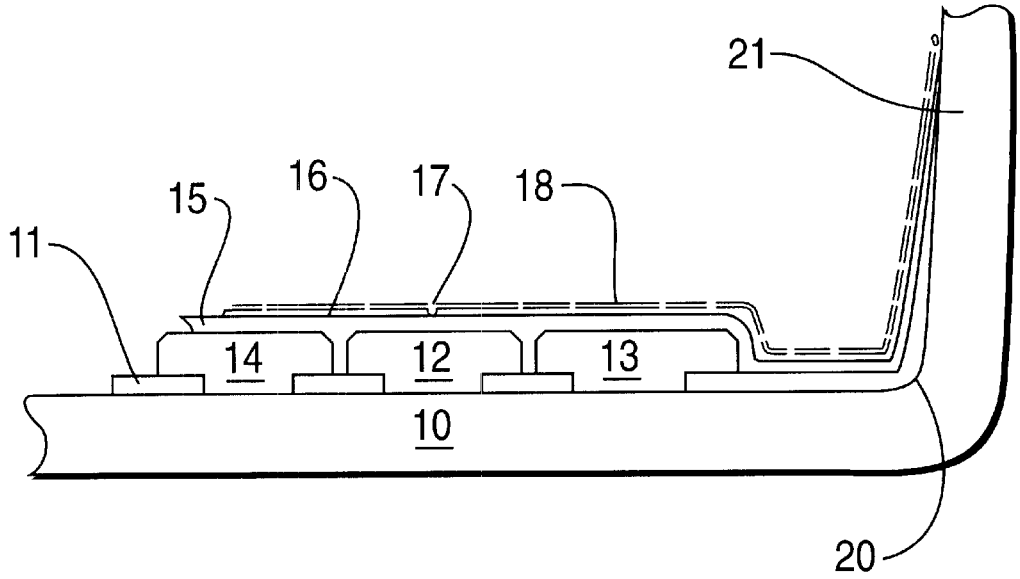
FIG. 2 is a cross-sectional view schematically showing the same corner of the panel as shown in FIG. 1, obtained after the baking process according to an embodiment of the present invention.

A method for metallizing a luminescent screen according the present invention will now be described with reference to FIG. 1 and FIG. 2. On the inner surface of a glass panel faceplate 10, three layers of phosphor materials 12 (green emitting), 13 (blue emitting) and 14 (red emitting) are successively deposited as stripes and arranged in a cyclic order to form a luminescent screen. A black matrix pattern 11 is sometimes deposited on the glass panel before phosphor application. The purpose of this light absorbing material is to improve the contrast on the finished tube, with each phosphor stripe being separated from the other by a black matrix material. Then, to provide a smooth surface for the metallic layer, at least one lacquer coating is applied and dried to form a film (15) over the phosphor surface. The lacquer coating is caused to cover the whole inner surface of the panel by spinning the panel, which also causes the lacquer to coat the inner blend radius and sidewall of the panel. The lacquer base may be of any conventional type for this purpose and may be applied by any of the well-known filming processes, such as emulsion or spray filming. Next, a water-based formulation of a styrene-acrylic copolymer is applied on the smooth film 15 in order to prevent aluminum blistering and flaking.

The copolymer formulation is dispersed onto the panel by spraying. Spraying the formulation is a convenient method, because it allows precise control of a very small quantity of copolymer material, which is needed to treat the panel. For example, the weight of copolymer needed to treat a panel of an average diagonal dimension of 27" is in a range of 0.2 mg to 2 mg. The acrylic support, due to its film forming temperature, around 30° C., appears to be the best way to form a layer which fixes the styrene portion of the copolymer on the smooth film 15. The copolymer formulation dries itself, because it was applied when the panel temperature was around 50° C., after the lacquer drying step.

The water-based of a stryrene-acrylic copolymer is applied on the internal surface of the panel and, more particularly, on the film portion overlying the panel blend radius 20 and the sidewall 21. The copolymer provides holes in the metallic layer and promotes better adhesion of the metallic layer to the panel glass surface. Without the copolymer, the panel glass is too smooth to retain the metallic layer, and, during further baking process steps, blisters can occur more easily on blend radius 20 and sidewall 21, because there are not enough holes in the metallic layer to allow the organic gas to escape.

The copolymer can be selected from the group of ROPAQUE® opaque polymers marketed by Rohm & Haas, for instance known under the reference HP-1055, HP-91, OP-842M, OP-96, OP-90E. An example of the copolymer formulation is listed in the table here below:

| Material | concentration | Amount × 10 kg |
|---|---|---|
| De-ionized water | q.b. to 100% | 9997 g |
| Copolymer | 300 ppm | 3 g |

The copolymer formulation forms a thin layer 16 containing hollow spheres 17. Then, a metallic layer 18, for example, an aluminum layer, is deposited on the thin layer 16 in a manner similar to that as described in the prior art, for example, in U.S. Pat. No. 3,067,055, issued to Saulnier on Dec. 4, 1979, or U.S. Pat. No. 3,582,390, issued to Saulnier on Jun. 1, 1988. The hollow spheres 17 have a diameter a little larger than the metallic layer thickness. After metallization, the panel is sent to a baking oven for organic bake-out.

In the baking process, the tube temperature begins to increase. When the copolymer layer temperature is in the 110° C. to 140° C. range, the hollow spheres 17 burst, producing small holes 19 in the overlaying metallic layer. The decomposition of the organic starts at higher temperatures, and the gas escape is facilitated through the small holes 19 produced at low temperature, whereby metallic blistering is prevented. It has to be noticed that the thin layer 16 of the styrene-acrylic copolymer is also removed by organic bake-out. The large number of minute holes produced in the metallic layer also avoid any local gas over pressure which may cause metallic bulging, thereby preventing metallic flaking of the metallic layer.

By use of the copolymer, good results, in terms of reflectivity of the metallized layer, are obtained with hollow spheres having a diameter in a range from 0.2 $\mu$m to 3 $\mu$m. Smaller sizes are not efficient enough in providing holes on the metallized layer, which still leaves the possibility of blistering the metallized layer. Larger size spheres result in a poor quality of reflectivity because of an excessive roughness of the layer.

Figure 3:
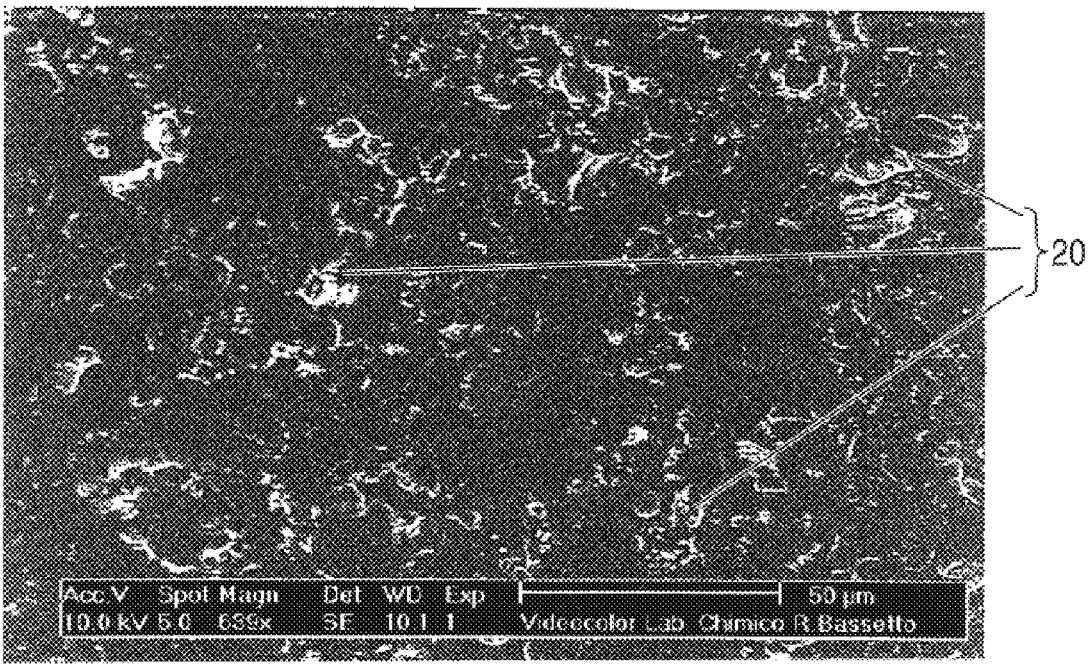
FIG. 3 is a magnified photograph showing a typical aspect of an internal glass panel surface sprayed with a 3% boric acid solution and dried.
Figure 4:
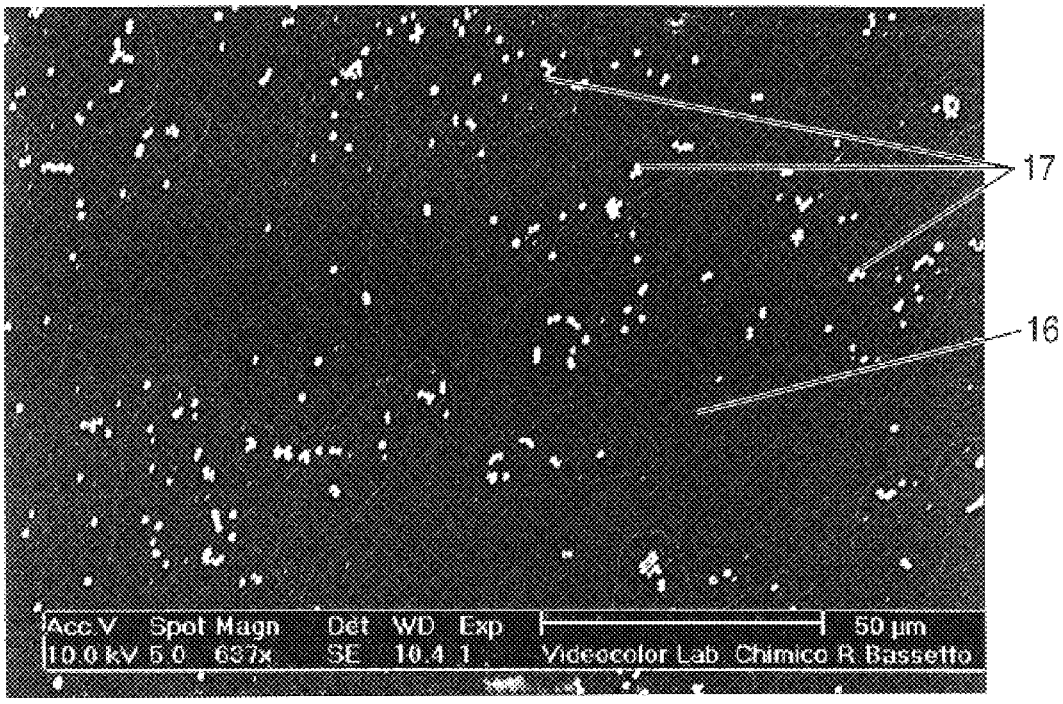
FIG. 4 is a magnified photograph showing a typical aspect of an internal glass panel surface sprayed with a 0.1 wt. % formulation of styrene-acrylic copolymer and dried.

FIGS. 3 and 4 show the difference in the appearance of a panel inner surface before metallization, when the panel is processed in a conventional way (FIG. 3, with a spray of boric acid onto the organic film 15) and when it is processed with the method according to the invention (FIG.4). In FIG. 3, it can be seen that there are large rough areas 30 occurring when the panel is processed with acid boric spray. In FIG. 4, the surface 16, resulting from use of a spray of styrene-acrylic formulation according to the invention, remains very smooth with very small styrene spheres 17.

An advantage of the invention is related to the manufacturing process flow. The panel screening process previously used comprises matrix material application, phosphor applications, lacquer application and a spray of boric acid. This process is made in white rooms, called screening rooms. The panels are then stored before the metallization step. Such a screening process does not allow for metallization of the panel several days after screening. For example, during weekend plant shut down, the exposure of the crystals of boric salt to the moisture of ambient air makes the crystals less sharp and unable to perform their function, which is to create holes on the metallized layer. With a process according to the invention, a panel being sprayed with the water-based formulation of the styrene-acrylic copolymer formulation can remain in ambient air during several hours or days before it has to be metallized.

The present invention is not limited to the use of polymer hollow spheres. Any other material that burst at a temperature lower than the starting organic decomposition temperature, close to 250° C., can be used to get the same effect.

What is claimed is:

1. A method for manufacturing a metallized luminescent screen, for a cathode-ray tube including the steps of:

depositing at least one phosphor layer on an inner surface of a faceplate of a panel to form said luminescent screen;

depositing on said layer a sub-layer consisting of a lacquer;

drying said sub-layer to form a film;

coating at least partially said film with an aqueous formulation of a styrene-acrylic copolymer;

drying the copolymer coating;

depositing a metallic layer onto said copolymer coating; and removing by decomposition organic materials contained in the luminescent screen, the film and the copolymer coating, by baking the panel, wherein the formulation for coating the film contains polymer hollow spheres and the spheres burst at a lower temperature than the decomposition temperature of the hollow spheres.

2. A method for manufacturing a metallized luminescent screen according to claim 1, wherein the polymer hollow spheres are composed of styrene-acrylic copolymer.

3. A method for manufacturing a metallized luminescent screen according to claim 2, wherein the diameter of said spheres is in a range from 0.2 $\mu$m to 3 $\mu$m.

4. A method for manufacturing a metallized luminescent screen according to claim 2, wherein the formulation for coating the film contains 0.01% to 0.1% by weight of the copolymer, the balance being water.

5. A method for manufacturing a metallized luminescent screen for a cathode-ray tube including the steps of:

depositing at least one phosphor layer on an inner surface of a faceplate of a panel to form said luminescent screen;

depositing on said layer a sub-layer consisting of a lacquer;

drying said sub-layer to form a film;

forming a copolymer coating by coating at least partially said film with a formulation comprising means for providing holes in a metallic layer deposited onto said copolymer coating;

depositing said metallic layer onto said copolymer coating; and removing by decomposition organic materials contained in the luminescent screen, the film and the copolymer coating, by baking the panel; and characterized in that the means for providing holes in the metallic layer comprises hollow spheres bursting during panel baking, wherein the hollow spheres burst at a lower temperature than the decomposition temperature of the hollow spheres.

6. A method for manufacturing a metallized luminescent screen according to claim 5, wherein the hollow spheres in the formulation for coating the film are styrene-acrylic copolymer hollow spheres.

7. A method for manufacturing a metallized luminescent screen according to claim 6, characterized in that the formulation for coating the film contains 0.01% to 0.1% by weight of the styrene-acrylic copolymer, the balance being water.

8. A method for manufacturing a metallized luminescent screen according to claim 5, characterized in that the diameter of the spheres is chosen in a range from 0.2 $\mu$m to 3 $\mu$m.

* * * * *

UNITED STATES PATENT AND TRADEMARK OFFICE

CERTIFICATE OF CORRECTION

PATENT NO. : 6,468,581 B1
DATED : October 22, 2002
INVENTOR(S) : Antimo Pezzulo et al.

It is certified that error appears in the above-identified patent and that said Letters Patent is hereby corrected as shown below:

Title page,
Item [57], the ABSTRACT should read as shown below:

ABSTRACT

A method for manufacturing a metallized luminescent screen, for a cathode-ray tube, includes the steps of:

depositing at least one phosphor layer on an inner surface of a faceplate of a panel to form said luminescent screen, depositing on said layer a sub-layer consisting of a lacquer, drying said sub-layer to form a film, coating at least partially the internal surface of the faceplate panel with an aqueous formulation of a styrene-acrylic copolymer, drying the copolymer coating, depositing a metallic layer onto said copolymer coating, removing the organic materials contained in the luminescent screen, the film and the copolymer coating, by baking the tube panel.

Signed and Sealed this

Eleventh Day of March, 2003

JAMES E. ROGAN
*Director of the United States Patent and Trademark Office*